US009644798B2

(12) United States Patent
Gielen

(10) Patent No.: US 9,644,798 B2
(45) Date of Patent: May 9, 2017

(54) BASE FOR AN ELECTRICAL LAMP THAT PREVENTS ROTATION AND A MORE EFFICIENT METHOD OF ASSEMBLING A BASE FOR AN ELECTRICAL LAMP

(71) Applicant: PHILIPS LIGHTING HOLDING B.V., Eindhoven (NL)

(72) Inventor: Vincent Stefan David Gielen, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 126 days.

(21) Appl. No.: 14/403,631

(22) PCT Filed: May 22, 2013

(86) PCT No.: PCT/IB2013/054237

§ 371 (c)(1),
(2) Date: Nov. 25, 2014

(87) PCT Pub. No.: WO2013/182939

PCT Pub. Date: Dec. 12, 2013

(65) Prior Publication Data

US 2015/0159813 A1 Jun. 11, 2015

Related U.S. Application Data

(60) Provisional application No. 61/655,548, filed on Jun. 5, 2012.

(51) Int. Cl.
*F21K 99/00* (2016.01)
*F21V 21/00* (2006.01)
(Continued)

(52) U.S. Cl.
CPC ..... *F21K 9/13* (2013.01); *F21K 9/23* (2016.08); *F21K 9/90* (2013.01); *F21V 21/00* (2013.01);
(Continued)

(58) Field of Classification Search
CPC ... F21K 9/13; F21K 9/90; F21V 21/00; F21Y 2101/02
See application file for complete search history.

(56) References Cited

U.S. PATENT DOCUMENTS 7,965,023 B1 6/2011 Liang
2011/0028015 A1 2/2011 Mostoller et al.

FOREIGN PATENT DOCUMENTS

EP 1577921 A1 9/2005
EP 1833069 A1 9/2007
(Continued)

*Primary Examiner* — Joseph L Williams

(57) ABSTRACT

According to an aspect there is provided a base for an electric lamp. The base includes a tubular enclosure extending along an axial direction between a first and a second end portion of the enclosure, an insulator attached to the first end portion of the enclosure. The insulator has an inner portion facing towards an inner space of the enclosure, an outer portion facing away from said inner space and at least one channel for receiving a contact pin, the channel extending from the outer portion, through the insulator and leading into said inner space. The base also includes a housing for accommodating electrical circuitry for operating the electric lamp. The housing is attached to the inner portion of the insulator such that a rotation of the housing relative to the insulator about the axial direction is prevented, and a rotation of the housing relative to the enclosure is prevented.

13 Claims, 7 Drawing Sheets

(51) Int. Cl.

| | |
|---|---|
| ***H01J 5/54*** | (2006.01) |
| ***F21V 23/00*** | (2015.01) |
| ***F21K 9/90*** | (2016.01) |
| ***F21K 9/23*** | (2016.01) |
| *F21Y 101/00* | (2016.01) |

(52) U.S. Cl.
CPC ..... *F21V 23/006* (2013.01); *H01J 5/54* (2013.01); *F21Y 2101/00* (2013.01); *Y10T 29/49002* (2015.01)

(56) References Cited

FOREIGN PATENT DOCUMENTS

| | | | |
|---|---|---|---|
| EP | 2034508 | A1 | 3/2009 |
| EP | 2149742 | A2 | 2/2010 |
| EP | 2295844 | A2 | 3/2011 |

BASE FOR AN ELECTRICAL LAMP THAT PREVENTS ROTATION AND A MORE EFFICIENT METHOD OF ASSEMBLING A BASE FOR AN ELECTRICAL LAMP

CROSS-REFERENCE TO PRIOR APPLICATIONS

This application is the U.S. National Phase application under 35 U.S.C. §371 of International Application No. PCT/IB13/054237, filed on May 22, 2013, which claims the benefit of U.S. Provisional Patent Application No. 61/655,548, filed on Jun. 5, 2012. These applications are hereby incorporated by reference herein.

FIELD OF THE INVENTION

The present inventive concept relates to a base for an electrical lamp and a method of assembling a base for an electrical lamp.

BACKGROUND OF THE INVENTION

The development in the field of light emitting diodes (LEDs) has made it practicable and economical to replace traditional light sources, such as incandescent light lamps or fluorescent lamps, with LED lamps for both indoor and outdoor lighting. Given their favorable energy efficiency and long lifespan LED lamps are often considered more environmentally friendly than their traditional counter parts.

Today, LED lamps are available in various designs. Some LED lamp designs are compatible with existing lighting fixtures and sockets. For example a LED lamp may be provided with a threaded base which may be screwed into a socket (i.e. an Edison screw fitting). In one design a LED lamp comprises a lighting module including one or more LEDs arranged on a base comprising a threaded conducting enclosure and a housing including electrical circuitry such as an LED driver. The lighting module is attached to the housing which in turn is pinched to the enclosure, thereby providing a torsion resistant connection between the housing and the enclosure wherein the lamp may be screwed into a socket. U.S. Pat. No. 7,965,023 discloses another design comprising a heat dissipation housing, an insulation housing and an Edison electrode cap. The insulation housing comprises a power printed circuit board (PCB). An upper opening edge of the electrode cap is connected to a lower end of the insulation housing to combine into one piece by screw-connection manner. The electrode cap and the insulation housing are then installed in an axial through-hole of the heat dissipation housing.

SUMMARY OF THE INVENTION

It has been realized that there is room for improvement upon the above-described LED lamp designs. More specifically it has been realized that pinching of a housing to an enclosure or a screw-connection between an insulation housing and an electrode cap inter alia may limit the efficiency by which the base may be assembled. It is therefore an object of the present invention to address and at least partly reduce this shortcoming by providing a base which better lends itself for an efficient assembly.

According to a first aspect of the invention, this and other objects are achieved by a base for an electric lamp, comprising: a tubular enclosure extending along an axial direction between a first and a second end portion of the enclosure, an insulator attached to the first end portion of the enclosure such that a rotation of the insulator relative to the enclosure about the axial direction is prevented, the insulator having an inner portion facing towards an inner space of the enclosure, an outer portion facing away from said inner space and at least one channel for receiving an electrically conducting contact pin, the channel extending from the outer portion, through the insulator and leading into said inner space. The base further comprises a housing for accommodating electrical circuitry for operating the electric lamp. The housing is attached to the inner portion of the insulator such that a rotation of the housing relative to the insulator about the axial direction is prevented, wherein a rotation of the housing relative to the enclosure is prevented.

In accordance with the inventive first aspect it has been realized that an improved base, which may be assembled in an efficient and convenient manner, may be achieved by attaching the housing to the insulator such that a rotation of the housing is transferred to the insulator wherein a rotation of the housing relative to the insulator is prevented. Since a rotation of the housing relative to the enclosure is prevented a lamp comprising the inventive base may easily be inserted in a twisting movement into a corresponding socket, such as an Edison screw fitting socket or a bayonet mount socket. It has further been realized that the insulator and/or the housing, which advantageously both may be made of a plastic or glass material, easily may be provided with features enabling a quick and reliable connection between the insulator and the housing. Thereby a separate assembly step of pinching the housing to the enclosure or screwing the housing to the enclosure, which may be time consuming, may be avoided.

According to one embodiment the base further comprises an attachment member arranged to connect the insulator and the housing to each other such that a separation between the insulator and the housing is prevented in at least said axial direction. The housing may thereby be arranged at a fixed axial position with respect to the enclosure. Hence both a rotation and an axial displacement of the housing with respect to the enclosure may be prevented.

The attachment member may form part of the insulator and be arranged to engage with an engagement portion of the housing and the attachment member is welded to said engagement portion. The engagement portion may face in a direction towards the inner portion of the insulator. Alternatively, the attachment member may form part of the housing and be arranged to engage with an engagement portion of the insulator and the attachment member may be welded to said engagement portion. The engagement portion may face in a direction towards the housing. According to these options the attachment member is arranged to prevent a separation between the insulator and the housing in at least said axial direction and to prevent a rotation of the housing relative to the insulator about said axial direction. Hence the housing only needs to be connected to the enclosure by means of the attachment member and the insulator.

The attachment member may be provided with a lateral projection or recess. The attachment member may form part with the insulator and extend towards the housing wherein the lateral projection or recess may be adapted to engage with an engagement portion of the housing such that a separation between the insulator and the housing is prevented in at least said axial direction. Alternatively, the attachment member may form part with the housing and extend towards the insulator wherein the lateral projection or recess may be adapted to engage with an engagement portion of the insulator such that a separation between the insulator and the housing is prevented in at least the axial direction. The housing and the insulator may thereby be attached to each other in an efficient manner by bringing the pieces together such that the lateral projection or recess may engage with the corresponding engagement portion. The attachment member and the engagement portion may thus form a snap-lock wherein the housing and the insulator may be attached to each other in a snap-lock configuration. The attachment member may be integrally formed with the insulator or the housing enabling a reduction of the number of parts that needs to be handled during assembly.

According to one embodiment an interface between the insulator and the housing is arranged to separate an inner space of the housing from an annular space formed between an outside of the housing and an inside of the enclosure. In case potting material is entered into the housing, the interface may prevent a leakage of potting material into the annular space which otherwise could occur. This may reduce the risk of potting material interfering with other parts of the base and may also reduce the amount of potting material required to fill the housing.

According to one embodiment the inner portion of the insulator is provided with a first surface extending in said axial direction towards an end portion of the housing, and an end portion of the housing is provided with a second surface extending in said axial direction towards the inner portion of the insulator, wherein the first surface and the second surface are arranged to extend along and in contact with each other. The first and the second surface may thus cooperate to prevent a rotation of the housing relative to the insulator about the axial direction. The torsion resistance of the connection between the housing and the insulator may thereby be advantageously strengthened.

According to one embodiment the insulator comprises a partition member arranged at the inner portion of the insulator and extending in said axial direction towards an end portion of the housing. In case potting material is entered into the housing, the partition member may thus prevent a leakage of potting material past the partition member. In embodiments including the above mentioned attachment member, the attachment member may form part of an edge portion of the partition member of the insulator and be welded to the engagement portion of the housing. Hence, the partition member may present a double function of enabling a torsion-resistant connection with the housing and at a same time provide a potting leakage barrier. Alternatively, the housing may comprise a partition member arranged at an end portion of the housing and extending in said axial direction towards the inner portion of the insulator.

According to one embodiment the insulator comprises a partition member arranged at the inner portion of the insulator and extending in said axial direction towards an end portion of the housing, the housing comprises a partition member arranged at an end portion of the housing and extending in said axial direction towards the inner portion of the insulator, and a side surface of the partition member of the insulator extends along and in contact with a side surface of the partition member of the housing. This embodiment enables the torsion resistance of the connection between the housing and the insulator to be advantageously strengthened and may in addition prevent a leakage of potting material from the housing as previously discussed.

According to one embodiment the enclosure includes an electrically conducting material, such as a metal. The enclosure may be provided with an outer thread. The base may hence be used in an Edison-type screw fitting.

In some embodiments the housing may comprise a wire channel arranged to accommodate a connection wire extending from an inner space of the housing into an annular space formed between an outside of the housing and an inside of the enclosure. Circuitry arranged in the housing may thereby be galvanically connected to a conducting portion of the enclosure in a convenient manner.

According to one embodiment the housing comprises a connection portion arranged at the end portion of the housing and comprising a first channel being axially aligned with the at least one channel of the insulator arranged to receive the electrically conducting contact pin, the connection portion being arranged to receive an end portion of the contact pin and a connection wire extending from an inner space of the housing. Circuitry in the housing may thereby be galvanically connected to the contact pin in a convenient manner by arranging the connection wire in the first channel of the connection portion and thereafter inserting the contact pin therein. The connection portion may further comprise a second channel extending through a wall of the connection portion and leading into the channel, the second channel being arranged to receive the connection wire. The connection wire may thus be arranged to extend through the second channel and into the first channel. The second channel may thereby serve as a holding portion for the connection wire before and while the contact pin is inserted into the first channel.

According to a second aspect there is provided an electrical lamp comprising a base, in accordance with the first aspect or any of the above-mentioned embodiments thereof, and a lighting module arranged on the base and including at least one light source.

According to a third aspect there is provided a method comprising: providing a tubular enclosure extending along an axial direction between a first and a second end portion of the enclosure, and an insulator attached to the first end portion of the enclosure such that a rotation of the insulator relative to the enclosure about the axial direction is prevented, the insulator having an inner portion facing towards an inner space of the enclosure, an outer portion facing away from said inner space and at least one channel for receiving an electrically conducting contact pin, the channel extending from the outer portion, through the insulator and leading into said inner space. The method further comprises attaching a housing for accommodating electrical circuitry for operating the electric lamp to the inner portion of the insulator such that a rotation of the housing relative to the insulator about the axial direction is prevented, wherein a rotation of the housing relative to the enclosure is prevented.

The details and advantages discussed in connection with the first aspect and the embodiments thereof apply correspondingly to the second and third aspects of the present inventive concept. For brevity, the discussion will therefore not be repeated here.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention wherein like reference numerals refer to like elements throughout unless stated otherwise.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
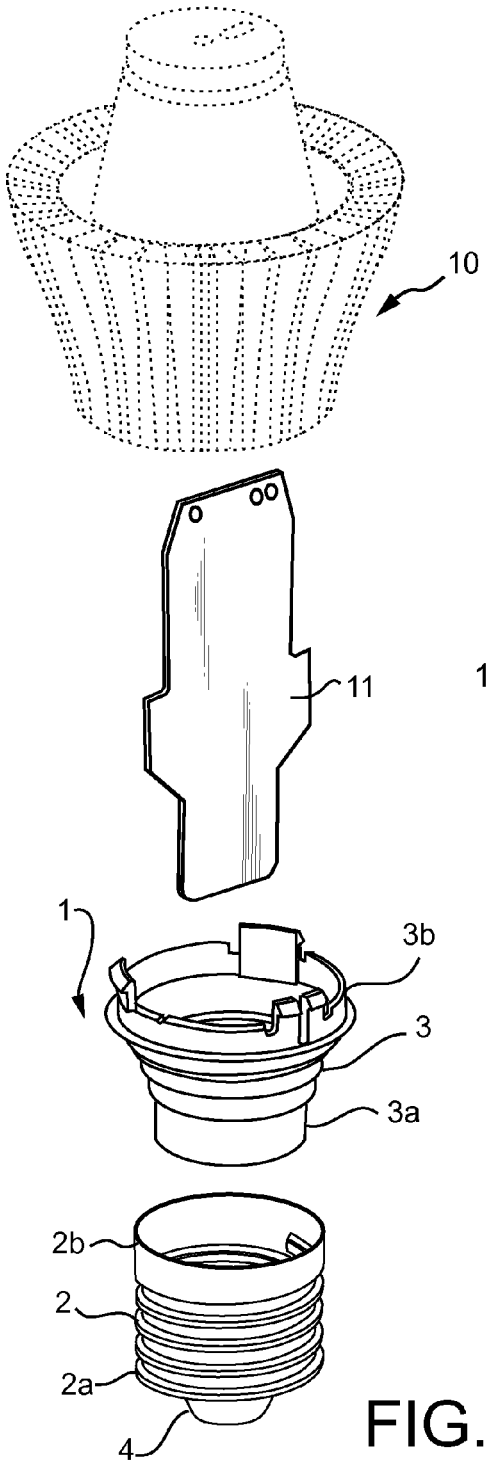
FIG. 1 is a perspective view of a base in an unassembled condition in accordance with an embodiment of the invention.
Figure 2:
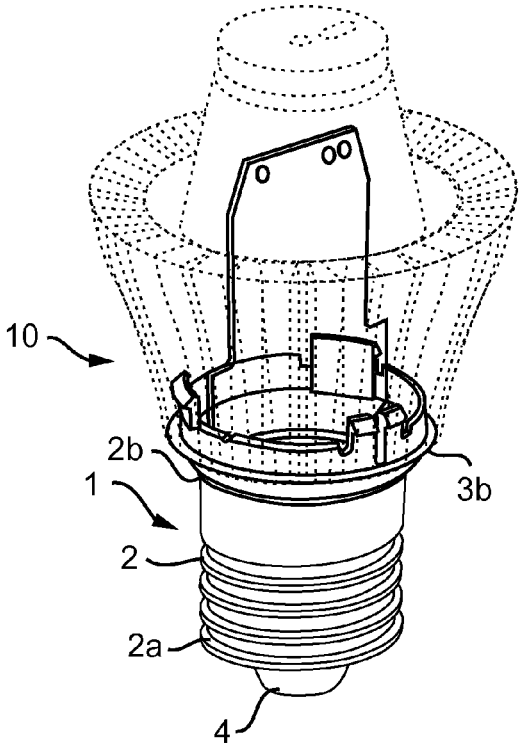
FIG. 2 is a perspective view of the base in an assembled condition.

FIGS. 1 and 2 illustrate a base 1 for an electric lamp in accordance with one embodiment. FIG. 1 illustrates the base 1 in an unassembled condition. FIG. 2 illustrates the base 1 in an assembled condition. The base 1 comprises an electrically conducting tubular enclosure 2. The enclosure 2 is provided with an outer thread. The outer thread enables the base 1 to be screwed into an Edison-type socket. The enclosure 2 extends between a first end portion 2*a* and a second end portion 2*b*. This direction of extension may be referred to as an axial direction of the enclosure 2 and analogously an axial direction of the base 1. The enclosure 2 forms a first contact or side contact of the base 1.

The base 1 comprises an electrically insulating housing 3. The housing 3 may comprise a polymer material, such as an engineering plastics, a thermoplastic engineering plastics, polybutylene terephthalate (PBT) or polycarbonate (PC), or a glass material. The housing 3 extends along the axial direction between a first end portion 3*a* and a second end portion 3*b*. The housing 3 is arranged to be received in the enclosure 2 from the open end of the enclosure 2 at the second end portion 2*b* thereof. When the enclosure 2 and the housing 3 are assembled, at least a portion of the housing 3 extends into the cylindrical inner space enclosed by the enclosure 2. The first end portion 3*a* extends into the inner space enclosed by the enclosure 2. The second end portion 3*b* extends out of the inner space enclosed by the enclosure 2. Thus, in the illustrated embodiment only a portion of the housing 3 is received inside the enclosure 2. However, in alternative embodiments the entire housing 3 may be received inside the enclosure 2. The housing 3 is arranged to receive and accommodate electrical circuitry 11 for operating the electric lamp, e.g. in the form of a printed circuit board. The light source of the electric lamp may comprise one or more light emitting diodes (LEDs) wherein the electrical circuitry 11 may comprise an LED driver for driving the LED(s).

The base 1 comprises an electrically insulating end member, hereinafter referred to as the insulator 4. The insulator 4 may comprise a polymer material, such as an engineering plastics, a thermoplastic engineering plastics, polybutylene terephthalate (PBT) or polycarbonate (PC), or a glass material. The insulator 4 may advantageously be injection molded. The insulator 4 is attached to the first end portion 2*a* of the enclosure 2 such that a rotation of the insulator 4 relative to the enclosure 2 about the axial direction is prevented. The housing 3 in turn is attached to the insulator 4 such that a rotation of the housing 3 relative to the insulator 4 about the axial direction is prevented. Consequently, a rotation of the housing 3 relative to the enclosure 2 may be prevented. This will be described in greater detail below.

As illustrated in FIGS. 1 and 2 the second end portion 3*b* may be provided with features for connecting the housing 3 to further components such as a lighting module including one or more light sources. Thereby an electric lamp may be provided comprising the base 1 and the lighting module including one or more light sources. By way of example reference numeral 10 in FIGS. 1 and 2 schematically indicates the lighting module comprising one or more LEDs which are mounted on a finned cooling element. The LEDs may be protected by a transparent cover. The lighting module 10 may be attached to the second end portion 3*b* such that a rotation of the lighting module 10 relative the housing 3 about the axial direction may be prevented. As illustrated, the lighting module 10 may be attached to the housing 3 by means of a snap-lock. Alternatively the lighting module 10 may be glued to the housing 3. The lighting module 10 may serve as a gripping part of the lamp, allowing a user to handle the lamp and insert the base 1 into a socket by rotation of the gripping part. Alternatively or additionally the housing 3 may present a portion extending outside the enclosure and forming a gripping part.

Figure 3:
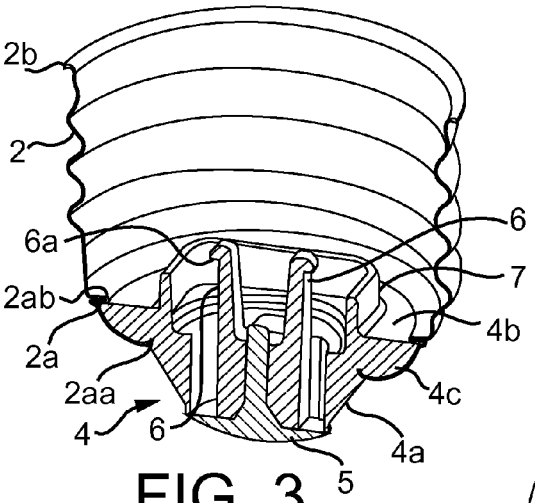
FIG. 3 is a sectional view of an enclosure and an insulator in accordance with an embodiment of the invention.
Figure 4:
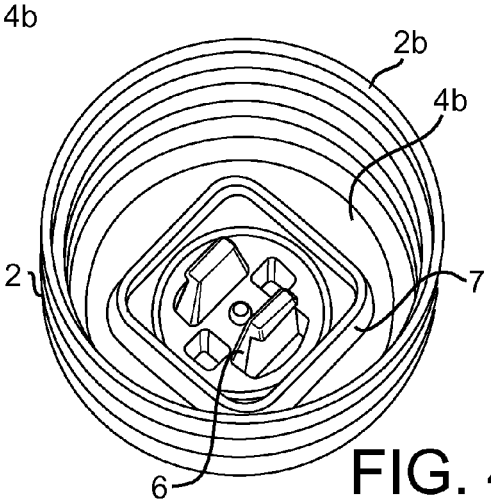
FIG. 4 is a perspective view of the enclosure and the insulator shown in FIG. 3.

FIG. 3 illustrates an axial sectional view of the enclosure 2 and the insulator 4. FIG. 4 is a perspective view of the enclosure 2 and the insulator 4 as seen from the second end portion 2*b* of the enclosure 2. The insulator 4 comprises an axially outer portion 4*a*. The outer portion 4*a* faces axially away from the inner space of the enclosure 2. The outer portion 4*a* thus provides an outer surface of the base 1. The insulator 4 comprises an axially inner portion 4*b*. The inner portion 4*b* faces axially towards the inner space of the enclosure 2. The inner portion 4*b* thus provides an inner surface within the enclosure 2.

The insulator 4 comprises a through-hole extending axially from the outer portion 4*a* to the inner portion 4*b* and leading into the inner space of the enclosure 2. The through-hole is arranged to receive a contact pin 5. The contact pin 5 extends into the through-hole of the insulator 4. The contact pin 5 forms a second contact or end contact of the base 1. The contact pin 5 may be galvanically connected to the circuitry 11 by means of a connection wire as will be described in more detail below.

The insulator 4 comprises an attachment portion 4*c*. The attachment portion 4*c* is press-fit or clamped between two lateral protrusions 2*aa* and 2*ab* provided at the first end portion 2*a* of the enclosure 2. Alternatively the insulator 4 may be injection molded at the position between the protrusions 2*aa* and 2*ab*. The protrusion 2*aa* extends into a circumferential groove of the insulator 4. The protrusion 2*ab* abuts the attachment portion 4*c* along an annular surface of the insulator 4 facing towards the inner space of the enclosure 2, i.e. an annular surface of the inner portion 4*b*. The tight fit of the attachment portion 4*c* between the respective protrusions 2*aa*, 2*ab* prevents a rotation of the insulator 4 relative to the enclosure 2 about the axial direction. Thus, a rotation of the insulator 4 about the axial direction may be transferred to the enclosure 2 via the attachment portion 4*c*. Additionally or alternatively the insulator 4 (or the attachment portion 4*c* thereof) may be pinched and/or glued to the end portion 2*a* of the enclosure 2. Additionally or alternatively the enclosure 2 may be provided with a toothed gripping portion including one or more teeth extending in a radially inward direction from an edge portion of the opening in the enclosure 2 at the first portion 2*a* (e.g. one or more teeth may extend from the edge forming protrusion 2*aa*). The one or more teeth may be circumferentially distributed along the edge portion. The toothed gripping portion may engage with the insulator 4 and thereby prevent a rotation of the insulator 4 about the axial direction in relation to the enclosure 2. Optionally the insulator 4 may be provided with one or more indents arranged to receive a respective tooth. The one or more indents may be circumferentially distributed about the insulator 4.

The insulator 4 comprises two resilient attachment members 6. The attachment members 6 may be integrally formed with the insulator 4 in a single piece or separately formed and mounted on the insulator 4 by means of welding, gluing or the like. Each of the attachment members 6 extends from the inner portion 4*b* of the insulator 4 along the axial direction towards the second end portion 2*b* of the enclosure 2. At a free end each attachment member 6 comprises a lateral projection providing an engagement surface 6*a*. In an alternative embodiment the engagement surface 6*a* may instead be provided by a lateral recess in each attachment member 6. The engagement surface 6*a* faces in a direction towards the inner portion 4*b* of the insulator 4. The engagement surface 6*a* may cooperate with a corresponding engagement portion of the housing 3 as will be discussed in more detail below.

Figure 5:
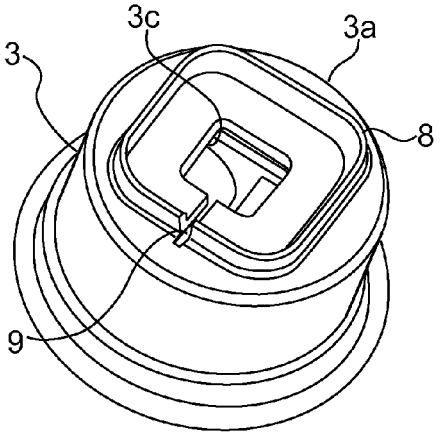
FIG. 5 is a perspective view of a housing in accordance with an embodiment of the invention.

FIG. 5 is a perspective view of the first end portion 3*a* of the housing 3. The first end portion 3 is provided with an opening which, in an assembled condition, faces the inner portion 4*b* of the insulator 4. The edge of the opening provides an engagement portion 3*c* for the attachment members 6.

Figure 6:
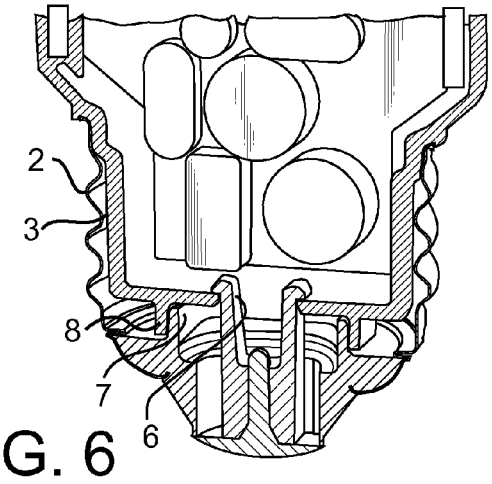
FIG. 6 is a sectional view of an enclosure, an insulator and a housing in accordance with an embodiment of the invention.

FIG. 6 is an axial sectional view of the enclosure 2, the housing 3 and the insulator 4 in an assembled condition. The insulator 4 and the housing 3 are attached to each other in a snap-lock configuration. The attachment members 6 and the engagement portion 3*c* are arranged to cooperate such that an axial separation of the insulator 4 and the housing 3 is prevented. Each attachment member 6 extends through the opening of the housing 3 and past the edge of the opening such that the respective engagement surface 6*a* engages the engagement portion 3*c* of the housing 3.

Still referring to FIGS. 3-6, the insulator 4 comprises a partition member 7 arranged on the inner portion 4*b* of the insulator 4 and extending in the axial direction towards the second end portion 2*b* of the enclosure 2. The housing 3 comprises a corresponding partition member 8 arranged on the first end portion 3*a* of the housing 3 and extending in the axial direction towards the first end portion 2*a* of the enclosure 2. The partition members 7, 8 may be integrally formed, in a single piece, with the insulator 4 and the housing 3, respectively, or separately formed and mounted thereon by means of welding, gluing or the like. As may be seen in FIG. 5 the first end portion 3*a* of the housing 3 may be provided with a wire channel 9 extending through the partition member 8 for allowing a connection wire to extend from an inner space of the housing 3 into the annular space formed between the housing 3 and an inner surface of the enclosure 2.

In the assembled condition shown in FIG. 6, the partition member 8 is arranged radially outside of the partition member 7. The radially outer side surface of the partition member 7 engages the radially inner side surface of the partition member 8. In alternative embodiments the partition member 7 may instead be arranged radially outside of the partition member 8. According to these alternative embodiments a radially outer side surface of the partition member 8 engages a radially inner side surface of the partition member 7.

The partition member 7 may extend the full distance from the inner portion 4*b* of the insulator 4 to the first end portion 3*a* of the housing 3. The partition member 7 may thus engage or abut against the first end portion 3*a* of the housing 3. Alternatively, the partition member 7 may extend only a part of the distance from the inner portion 4*b* of the insulator 4 to the first end portion 3*a* of the housing 3. Similarly, the partition member 8 may extend the full distance from the first end portion 3*a* of the housing 3 to the inner portion 4*b* of the insulator 4. The partition member 8 may thus engage or abut against the inner portion 4*b* of the insulator 4. Alternatively, the partition member 8 may extend only a part of the distance from the first end portion 3*a* of the housing 3 to the inner portion 4*b* of the insulator 4. In any event, the partition member 7 and the partition member 8 may present an axial extension such that they overlap along the axial direction.

The partition members 7 and 8 may provide a two-fold advantage: Firstly, the partition member 7 and 8 provide an interface between the insulator 4 and the housing 3 which separates an inner space of the housing 3 from the annular space formed between the exterior of the housing 3 and the inner surface of the enclosure 2. In case potting material is entered into the housing 3, the interface may prevent a leakage of potting material from the housing 3 into said annular space via the opening in the first end portion 3*a* of the housing 3. Secondly, the partition members 7 and 8 contribute to a torsion resistant connection between the housing 3 and the insulator 4 as will be better understood from the below.

In use of an electric lamp comprising the base 1 according to any of the above described embodiments, the base 1 of the lamp may be inserted to a socket. Insertion of the base 1 may include rotation of the lamp about the axial direction, e.g. by the user applying a torque in the axial direction to a portion of the lamp which is accessible to touch such as the above mentioned gripping part. The socket may comprise threads corresponding to the threads of the enclosure 2. The outer dimensions of the enclosure 2 and the corresponding inner dimensions of the socket may by way of example correspond to those of the E14 or E27 Edison screw fitting. The rotation resulting from the applied torque may be transferred to the housing 3. From the housing 3, the rotation may be transferred to the insulator 4 via the partition member 8 and the partition member 7. A rotation of the insulator 4 may be transferred to the enclosure 2 wherein the enclosure 2, and thus the base 1, may be screwed into the socket. An analogous transfer of torque and rotation may arise during unscrewing of the base 1 from the socket. Consequently, the housing 3 is attached to the insulator 4 such that a rotation of the housing 3 relative to the insulator 4 about the axial direction is prevented and the insulator 4 is attached to the enclosure 2 such that a rotation of the insulator 4 relative to the enclosure 2 about the axial direction is prevented, wherein a rotation of the housing 3 relative to the enclosure 2 is prevented.

During rotation a portion of the torque applied to the housing 3 may be transferred to the insulator 3 via the attachment members 6. In fact, in some embodiments the torque transfer capacity of the attachment members 6 may be sufficient wherein the partition members 7, 8 may be omitted. In such embodiments a rotation of the housing 3 relative to the insulator 4 may be prevented by means of the attachment members 6 only. In embodiments including partition members 7, 8 the ratio of torque transfer via the attachment members 6 and via the partition members 7, 8 may be varied e.g. by varying the stiffness of the attachment members 6 and the partition members 7, 8, respectively, the size of the contact surface between the attachment members 6 and the housing 3, and the size of the contact surface between the partition members 7 and 8. In the embodiment illustrated in FIG. 6 the contact surface between the partition members 7 and 8 is greater than the contact surface between the attachment members 6 and the housing 3. The partition members 7, 8 may thus transfer a larger portion of the torque from the housing 3 to the insulator 4 than the attachment members 6.

In the illustrated embodiment the attachment member 6 is provided on the insulator 4 and the engagement portion 3*c* is provided on the housing 3. In alternative embodiments the attachment member 6 may instead be provided on the first end portion 3*a* of the housing 3 and the engagement portion 3*c* may be provided on the insulator 4. Moreover, in the illustrated embodiment the partition member 7 surrounds the attachment members 6 completely in the circumferential direction. In alternative embodiments the partition member 7 may surround the attachment members 6 only partly in the circumferential direction.

The base 1 may be efficiently and conveniently assembled by aligning the housing 3 and the insulator 4 axially and bringing the housing 3 and the insulator 4 together such that (where applicable) the partition member 7 is enclosed by the partition member 8 (or in some embodiments vice versa) and such that the attachment members 6 snap to the engagement portion 3*c*. The insulator 4 may have been assembled with the enclosure 2 in a previous step wherein the base 1 may be assembled by introducing the housing 3 into the enclosure 2, from the second end portion 2*b* thereof, and bring the housing 3 in contact with the insulator 4.

Figure 7:
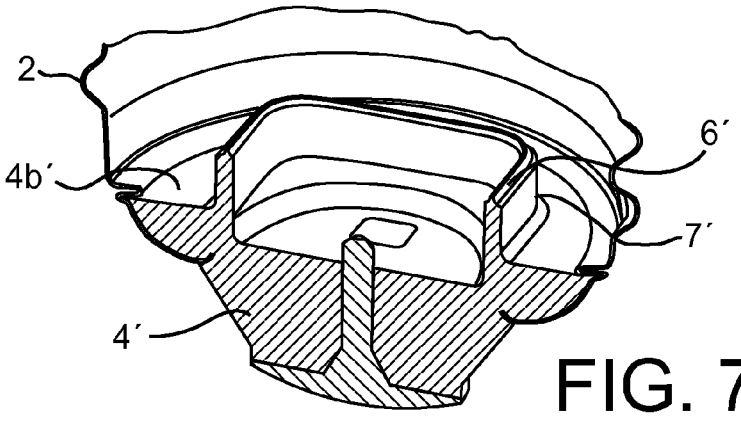
FIG. 7 is a sectional view of an enclosure and an insulator in accordance with an embodiment of the invention.
Figure 8:
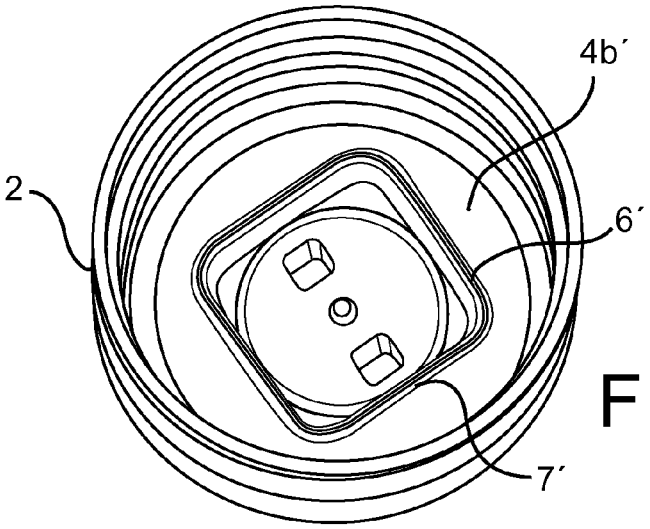
FIG. 8 is a perspective view of the enclosure and the insulator shown in FIG. 7.

FIGS. 7 and 8 illustrate an insulator 4' according to an alternative embodiment. The insulator 4' is similar to the insulator 4 however differs in that it comprises an attachment member 6' arranged at an end surface of the partition member 7'. The attachment member 6' extends in the axial direction away from the insulator 4'. The attachment member 6' presents a thickness (i.e. in the radial direction) which decreases along the axial direction to form a wedge. The attachment member 6' may be integrally formed with the partition member 7' wherein the partition member 7' may be said to present a tapered axially oriented end portion forming an attachment member 6'. The attachment member 6' may extend along the entire end surface of the partition member 7'. In other embodiments the attachment member 6' may extend only along one or more discrete sections of the end surface of the partition member 7'.

Figure 9:
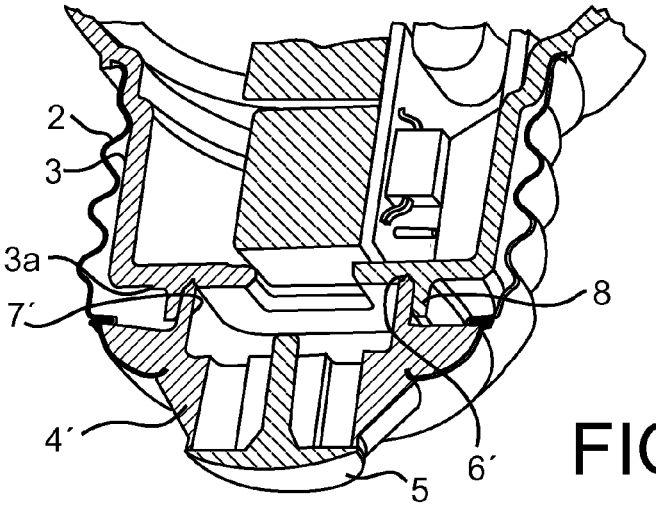
FIG. 9 is a sectional view of an enclosure, an insulator and a housing in accordance with an embodiment of the invention.

FIG. 9 illustrates the enclosure 2, the housing 3 and the insulator 4 in an assembled condition. The attachment member 6' is joined with or bonded to the first end portion 3*a* of the housing 3 by welding, for example ultrasonic welding. An ultrasonic vibration may for example be applied to the insulator 4'. The attachment member 6' may focus the vibration energy into a narrow contact surface between the attachment member 6' and the housing 3 and thereby form a weld joint. The contact surface of the first end portion 3*a* of the housing 3 thus forms an engagement portion for the attachment member 6'. By the welding of the attachment member 6' to the housing 3 an axial separation of the insulator 4 and the housing 3 is prevented. Moreover, in analogy with the above discussion, a torque or a rotation applied to the housing 3 may be transferred to the insulator 4 via the partition members 7' and 8. Also in analogy with the above discussion, a portion of the torque applied to the housing 3 may be transferred to the insulator 3 via the attachment members 6'. By the welding of the attachment member 6' to the housing 3 it is possible to form a circumferentially extended weld joint between the attachment member 6' and the housing 3 capable of transferring a substantial amount (i.e. substantial in the context of normal use of electric lamps) of torque between the housing 3 and the insulator 4'. Hence in some applications the torque transfer capacity of the attachment member 6' may be sufficient wherein the partition member 8 of the housing 3 may be omitted. In such embodiments a rotation of the housing 3 relative to the insulator 4' may be prevented by means of the attachment member 6' only. The insulator 4' may also be attached to the housing 3 using other types of welding such as friction welding, vibration welding or mirror welding.

In the illustrated embodiment the attachment member 6' is provided on the partition member 7'. In alternative embodiments the attachment member 6' may instead be provided on the partition member 8 wherein the corresponding engagement portion may be provided on the inner portion 4*b'* of the insulator 4'.

Figure 10:
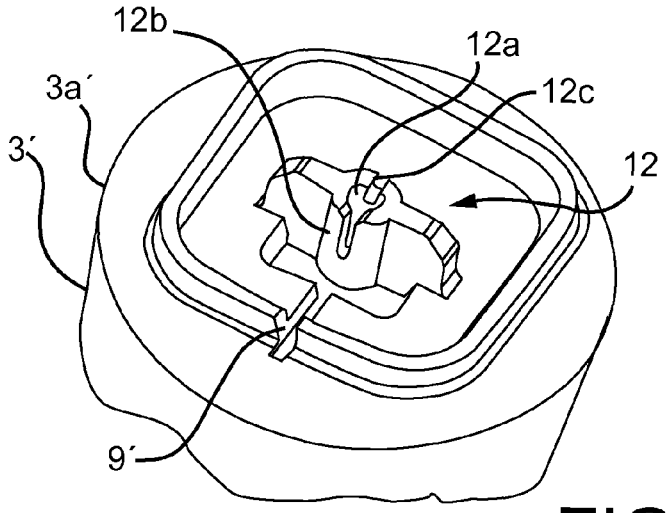
FIG. 10 is a perspective view showing an end portion of a housing in accordance with an embodiment of the invention.
Figure 11:
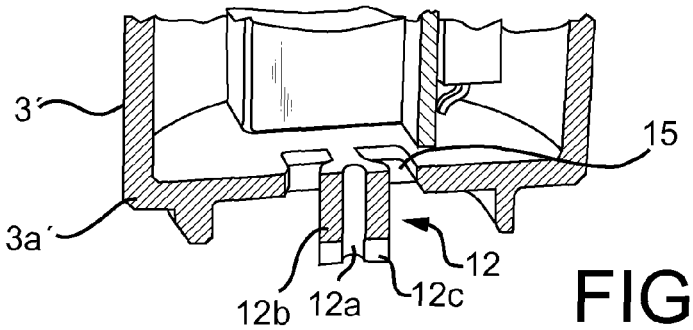
FIG. 11 is a sectional view of the housing shown in FIG. 10.
Figure 12:
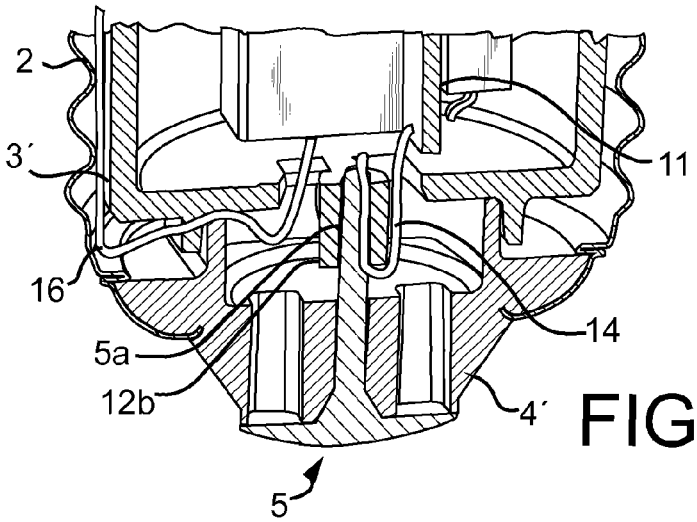
FIG. 12 is a sectional view of an enclosure, an insulator and a housing in accordance with an embodiment of the invention.

FIG. 10 illustrates a further development of a housing 3' in a perspective view. FIG. 11 illustrates a sectional view of the housing 3'. FIG. 12 illustrates a sectional view of a base comprising the housing 3', the housing being attached to the insulator 4'. The housing 3' is similar to the housing 3 but differs in that it comprises a connection portion 12 arranged at the first end portion 3*a'* thereof. The connection portion 12 is centrally arranged at the end portion 3*a'*. The connection portion 12 comprises an axially extending channel 12*a*. The channel 12*a* is enclosed circumferentially by a wall 12*b* of the connection portion 12. The connection portion 12 further comprises a lateral channel 12*c* extending through the wall 12*b* and leading into the channel 12*a*. The axial channel 12*a* is arranged to receive an end portion 5*a* of the contact pin 5. Referring to FIG. 12, the base further comprises a connection wire 14. The lateral channel 12*c* is arranged to receive the connection wire 14. The connection wire 14 is arranged to extend from the electrical circuitry 11 inside the housing 3', through an opening 15 in the end portion 3*a'* of the housing 3', and to the contact pin 5. A first end portion of the connection wire 14 is galvanically connected to the circuitry 11. A second end portion of the connection wire 14 opposite the first end portion is galvanically connected to the contact pin 5. The channel 12*c* may be provided with a cross sectional dimension falling below a cross sectional dimension of the connection wire 14 wherein a portion of the connection wire 14 received in the channel 12*c* may be tight fit or press-fit therein. This may facilitate handling of the housing 3' and the connection wire 14 during assembly. The connection wire 14 may thus be arranged to extend from the inner space of the housing 3' into the channel 12*c*, wherein a free end of the connection wire 14 may be arranged to extend into the channel 12*a*. As the end portion 5*a* of the contact pin 5 is received in the channel 12*a*, the free end of the connection wire 14 may be sandwiched and press-fit between the end portion 5*a* and the wall 12. The connection wire 14 may thus be brought into galvanic contact with the end portion 5*a* of the contact pin 5 at a fixed position without soldering.

The base may further comprise a second connection wire 16. The housing 3' may further include a channel 9' similar to the channel 9 for accommodating the second connection wire 16. The connection wire 16 may be arranged to extend from the electrical circuitry 11 inside the housing 3', through the channel 9', and to the inner surface of the enclosure 2. A first end portion of the connection wire 16 may be galvanically connected to the circuitry 11. A second end portion of the connection wire 16, opposite the first end portion, may be galvanically connected to the inner surface of the enclosure 2. The relative radial dimensions of the enclosure 2 and the housing 3' may be such that a radial thickness of the annular space falls below a thickness of the connection wire 16 wherein the connection wire 16 may be sandwiched and press-fit between the enclosure 2 and the housing 3'. The connection wire 16 may thus be brought into galvanic contact with enclosure 2 at a fixed position without soldering. Analogously to the discussion above, the interface between the housing 3' and the insulator 4' prevents a leakage of potting material into the space between the housing 3' and the enclosure 2. Thereby, the risk of having potting material, which may present thermal expansion during use of the lamp, interfering with the contact between the connection wire 16 and the enclosure 2 may be reduced. A reliable connection between the connection wire 16 and the enclosure 2 may thus be achieved without soldering, even when potting material is used.

The base design illustrated in FIG. 12 enables attachment of the housing 3' to the insulator 4 and connection of the connection wires 14 and 16 to the contact pin 5 and the enclosure 2, respectively, in a single assembly step. The connection wire 14 may be arranged to extend from the circuitry 11 and through the channel 12*c*. The connection wire 16 may be arranged to extend from the circuitry 11 and through the channel 9'. The housing 3' and the insulator 4, including the contact pin 5, may be axially aligned and brought together such that the end portion 5*a* of the contact pin 5 becomes inserted in the channel 12*a* and the connection wire 16 is sandwiched between the enclosure 2 and the housing 3'. The insulator 4 may be attached to the housing 3' by welding or alternatively by means of a snap-lock configuration as described above.

The above described arrangement of the connection wire 16 is applicable also to embodiments not including the connection portion 10. For example, a connection wire may be arranged in a similar manner in the base illustrated in FIGS. 6 and 9. In embodiments not including the connection portion 10 a connection wire corresponding to the connection wire 14 may instead be attached to the contact pin 5 by soldering.

Figure 13:
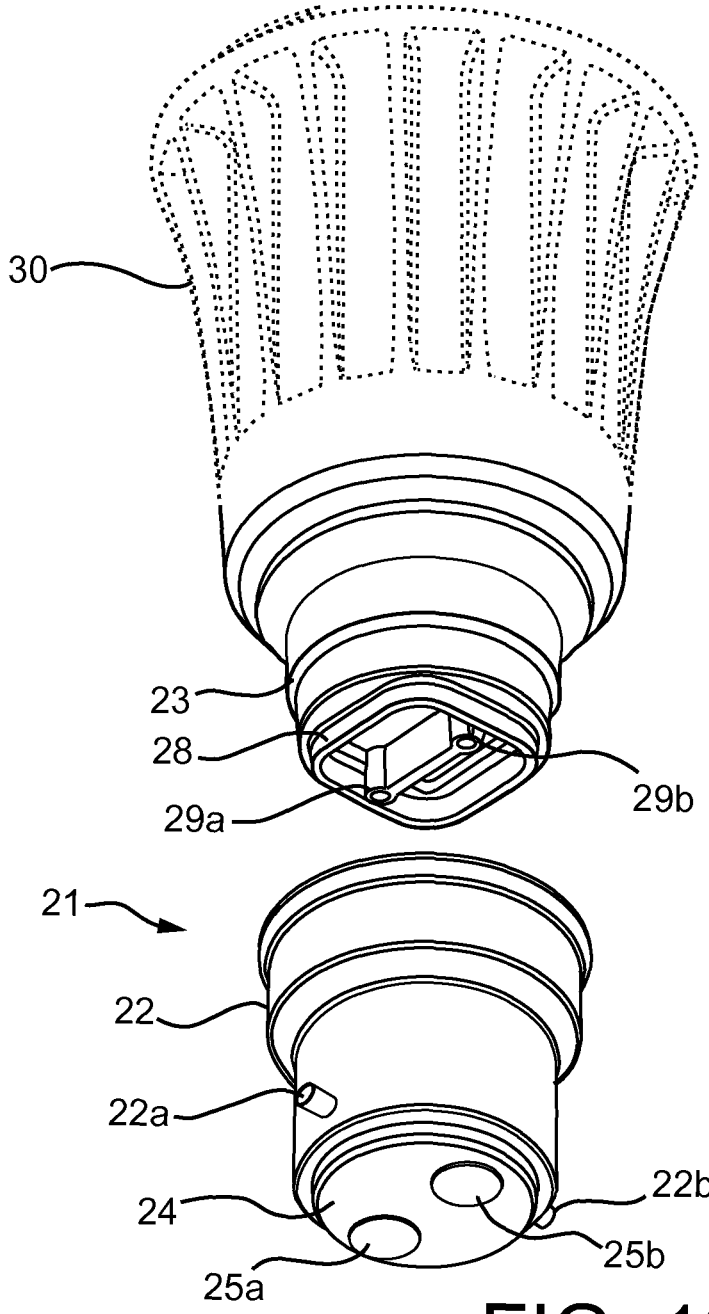
FIG. 13 is a perspective view of a base in accordance with a further embodiment.

FIG. 13 illustrates a base 21 of an alternative embodiment. The base 21 is similar to the base 1 however differs in that comprises an enclosure 22 which is arranged to be inserted into a bayonet-type socket, such as a B22 socket, a BA15 socket, a B15 socket or the like. In contrast to the enclosure 2, the enclosure 22 does not present any threading. Instead the enclosure 22 includes a first and a second pin 22*a*, 22*b* arranged at radially opposite sides of the enclosure 22 and each extending in a radially outward direction from the enclosure 22. The enclosure 22 may hence be inserted in a corresponding bayonet-type socket including L-shaped slots in which the respective pins 22*a*, 22*b* may be received and fixed by means of a rotational movement.

Figure 14:
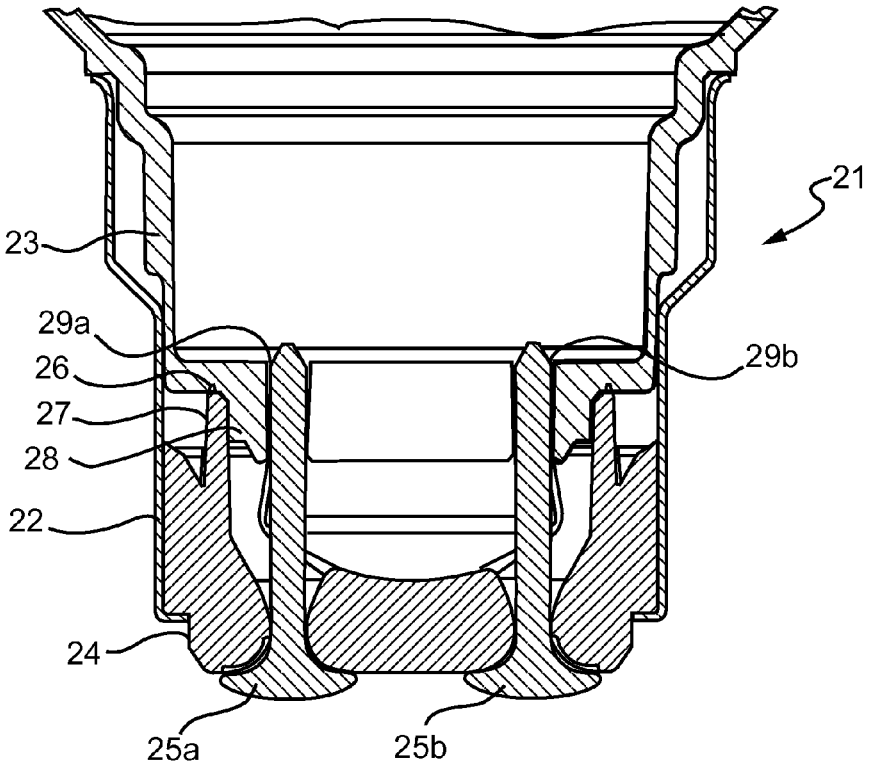
FIGS. 14-15 are sectional views of the base illustrated in FIG. 13.
Figure 15:
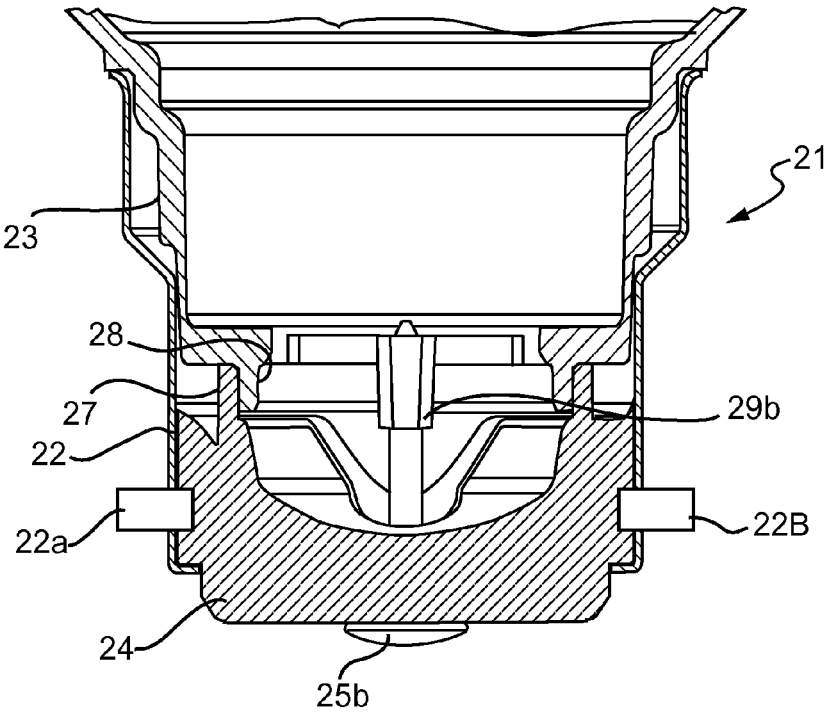

FIGS. 14 and 15 are sectional views of the base 21 taken along two mutually perpendicular axial sections of the base 21. The insulator 24, which corresponds to the insulator 4', comprises a partition member 27 corresponding to the partition member 7'. The housing 23, which corresponds to the housing 3 or 3', comprises a partition member 28 corresponding to the partition member 8. The housing 23 is attached to the insulator 24 by means of the attachment member 26 corresponding to the attachment member 6'. The attachment member 26 is thus welded to the housing 23. The bayonet type base 21 is however not limited to welded connection between the insulator 24 and the housing 23 but a bayonet type base wherein the housing 23 may be connected to the insulator 24 in a snap-lock configuration as illustrated in FIG. 6 is also possible.

As illustrated in FIGS. 13-15 the insulator 24 comprises a first and a second channel for receiving a respective contact pin 25*a* and 25*b* forming two end contacts of the base 21. The housing 23 may be provided with a pair of connection portions 29*a*, 29*b* arranged to receive a respective end portion of the contact pins 25*a* and 25*b*. The contact pins 25*a* and 25*b* may be received in the respective connection portions 29*a*, 29*b* in a tight-fit manner. The contact pins 25*a* and 25*b* may be galvanically connected to a respective connection wire in a similar manner as described above. During insertion or removal of the base from a socket, a portion of the torque applied to the housing 23 may be transferred to the insulator 24 via the connection portions 29*a*, 29*b* and the contact pins 25*a* and 25*b*. In fact, in some embodiments the torque transfer capacity of the connection portions 29*a*, 29*b* and the contact pins 25*a* and 25*b* may be sufficient wherein the partition members 27, 28 may be omitted. For example a base comprising an attachment member, a first and a second contact pin (similar to the contact pins 25*a*, 25*b*) and a housing comprising a first and a second connection portion (similar to the connection portions 29*a*, 29*b*) is contemplated wherein the attachment member (e.g. in the form of a snap lock) is arranged to connect the insulator and the housing to each other such that a separation between the insulator and the housing is prevented in at least the axial direction and the contact pins and the connection portions are arranged to prevent a rotation of the housing relative to the insulator about the axial direction.

The person skilled in the art realizes that the present invention by no means is limited to the preferred embodiments described above. On the contrary, many modifications and variations are possible within the scope of the appended claims. For example, the housing 3, 3', 23 may be provided with another shape than cylindrical, a housing may present a triangular, a rectangular cross section or more generally a polygonal cross section.

Moreover, in the illustrated embodiments the partition members 7, 8, 27, 28 are provided with a substantially rectangular cross sectional shape. In alternative embodiments the partition members may instead be provided with a triangular shape or more generally a polygonal shape. In some embodiments the insulator and the housing may be provided with a respective circular or annular partition member Annular partition members may simplify assembly of a base since a relative rotation of the housing and the insulator about the axial direction need not be considered for bringing the pieces together Annular partition members may for example be used in applications wherein the torque transfer capacity of the attachment members 6, 6' or contact pins 25*a*, 25*b* is considered sufficient. In some embodiments a radially inner surface of an outer annular partition member (of the housing or the insulator) may be provided with one or more axially extending ribs and a radially outer surface of a an inner annular partition member (of the housing or the insulator) may be provided with one or more axially extending ribs, the one or more ribs of the outer and the inner partition members being arranged to engage each other such that a relative rotation the outer partition member and the inner partition member about the axial direction is prevented. Thereby annular partition members may be arranged to transfer a torque between the housing and the insulator.

Furthermore, although the illustrated embodiments have been described with reference to LED light sources the present invention, as defined in the claims, may be used in connection with other types of light sources. For example an electric lamp comprising one or more halogen light sources wherein the electrical circuitry in the housing may comprise circuitry for driving the halogen light source(s); or an electric lamp comprising a fluorescent light source wherein the electrical circuitry may comprise circuitry for starting and driving the fluorescent light source.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A base for an electric lamp, comprising:

a tubular enclosure extending along an axial direction between a first and a second end portion of the enclosure, an insulator attached to the first end portion of the enclosure such that a rotation of the insulator relative to the enclosure about the axial direction is prevented, the insulator having an inner portion facing towards an inner space of the enclosure, an outer portion facing away from said inner space at least one channel for receiving an electrically conducting contact pin, the channel extending from the outer portion, through the insulator and leading into said inner space, a housing for accommodating electrical circuitry for operating the electric lamp, and a resilient attachment member forming part of one of the insulator and the housing, said resilient attachment member extending towards the other one of the insulator and the housing and being arranged to connect the insulator and the housing to each other, said resilient attachment member further comprising a lateral projection providing an engagement surface and/or a lateral recess, wherein the housing is attached to the inner portion of the insulator such that a rotation of the housing relative to the insulator about the axial direction is prevented, wherein a rotation of the housing relative to the enclosure is prevented and wherein a separation between the insulator and the housing is prevented by said attachment member in at least said axial direction.

2. A base according to claim 1, wherein the attachment member is integrally formed with the insulator.

3. A base according to claim 1, wherein an interface between the insulator and the housing is arranged to separate an inner space of the housing from an annular space formed between an outside of the housing and an inside of the enclosure.

4. A base according to claim 1, wherein the insulator comprises a partition member arranged at the inner portion of the insulator and extending in said axial direction towards an end portion of the housing.

5. A base according to claim 3, wherein the housing comprises a partition member arranged at an end portion of the housing and extending in said axial direction towards the inner portion of the insulator.

6. A base according to claim 3, wherein:

the inner portion of the insulator provides a first surface extending in said axial direction towards an end portion of the housing, and the end portion of the housing provides a second surface extending in said axial direction towards the inner portion of the insulator, wherein the first surface and the second surface are arranged to extend along and in contact with each other.

7. A base according to claim 6, wherein a partition member of the housing comprises a wire channel arranged to accommodate a connection wire extending from an inner space of the housing into an annular space formed between an outside of the housing and an inside of the enclosure.

8. A base according to claim 6, wherein the housing comprises a connection portion arranged at the end portion of the housing and comprising a first channel being axially aligned with said at least one channel of the insulator and being arranged to receive an end portion of the electrically conducting contact pin and a connection wire extending from an inner space of the housing.

9. A base according to claim 8, wherein the connection portion comprises a second channel extending through a wall of the connection portion and leading into the channel, the second channel being arranged to receive the connection wire.

10. An electrical lamp comprising a base according to claim 1 and a lighting module arranged on the base and including at least one light source.

11. A method of assembling a base for an electrical lamp:

providing a tubular enclosure extending along an axial direction between a first and a second end portion of the enclosure, and an insulator attached to the first end portion of the enclosure such that a rotation of the insulator relative to the enclosure about the axial direction is prevented, the insulator having an inner portion facing towards an inner space of the enclosure, an outer portion facing away from said inner space and at least one channel for receiving an electrically conducting contact pin, the channel extending from the outer portion, through the insulator and leading into said inner space, providing a resilient attachment member forming part of one of the insulator and the housing, said resilient attachment member extending towards the other one of the insulator and the housing and being arranged to connect the insulator and the housing to each other, said resilient attachment member further comprising a lateral projection providing an engagement surface and/or a lateral recess; and attaching a housing for accommodating electrical circuitry for operating the electric lamp to the inner portion of the insulator with said resilient attachment member such that a rotation of the housing relative to the insulator about the axial direction is prevented, wherein a rotation of the housing relative to the enclosure is prevented and wherein a separation between the insulator and the housing is prevented by said attachment member in at least said axial direction.

12. A base according to claim 1, wherein the insulator comprises a partition member arranged at the inner portion of the insulator and extending in said axial direction towards an end portion of the housing.

13. A base according to claim 1, wherein the inner portion of the insulator provides a first surface extending in said axial direction towards an end portion of the housing, and the end portion of the housing provides a second surface extending in said axial direction towards the inner portion of the insulator, wherein the first surface and the second surface are arranged to extend along and in contact with each other.

* * * * *